US006179595B1

(12) United States Patent
Buchmüller

(10) Patent No.: US 6,179,595 B1
(45) Date of Patent: Jan. 30, 2001

(54) HYDRAULIC GEAR MACHINE HAVING A TRANSMISSION SHAFT IN A BEARING TUBE

(75) Inventor: Klaus-Dieter Buchmüller, Malsch (DE)

(73) Assignee: LuK Getriebe-Systeme GmbH, Buhl/Baden (DE)

( * ) Notice: Under 35 U.S.C. 154(b), the term of this patent shall be extended for 0 days.

(21) Appl. No.: 09/312,349

(22) Filed: May 14, 1999

(30) Foreign Application Priority Data

May 27, 1998 (DE) ..... 198 23 633

(51) Int. Cl.[7] ..... F04C 2/10; F04C 13/00
(52) U.S. Cl. ..... 418/104; 418/170
(58) Field of Search ..... 418/102, 104, 418/166, 170, 171, 206.1

(56) References Cited

U.S. PATENT DOCUMENTS 5,263,818 * 11/1993 Ito et al. ..... 418/171

FOREIGN PATENT DOCUMENTS

3410015 * 9/1985 (DE) ..... 418/170

* cited by examiner

*Primary Examiner*—John J. Vrablik
(74) *Attorney, Agent, or Firm*—Darby & Darby

(57) ABSTRACT

A hydraulic gear machine, particularly an internal-gear pump in a vehicular transmission, with an internal gear and an external gear, has a central bearing tube that rotatably supports the external gear and receives the input or output shaft of the transmission. The transmission shaft is rotatably supported in the bearing tube by means of a bearing that is radially interposed between the transmission shaft and the bearing tube.

14 Claims, 4 Drawing Sheets

5
21
91
11
6
13
7
7b
12
92
14
40
25
2
90
4
3
23
10
15
9
7a
8a
8
8b
22
20
41
24
1

HYDRAULIC GEAR MACHINE HAVING A TRANSMISSION SHAFT IN A BEARING TUBE

BACKGROUND OF THE INVENTION

The invention relates to a hydraulic gear machine such as a pump or motor, especially an internal-gear pump, external-gear pump, or similar device.

Hydraulic gear machines of this kind have become known through, e.g., DE-OS 2942417. Pumps of the type described therein are powered through a separate shaft driven by a drive motor. This configuration has the disadvantage that it requires the use of an additional element and takes up more space.

OBJECT OF THE INVENTION

One object of the present invention is to provide a hydraulic gear machine that has a small number of parts and saves as much space as possible.

SUMMARY OF THE INVENTION

In hydraulic gear machines according to the invention, the stated object is attained in that a central bearing tube is provided on which the second gear, e.g., a pinion, is rotatably supported, the bearing tube surrounds a transmission shaft of a vehicular transmission, and the transmission shaft is rotatably supported by a bearing that is radially interposed between the transmission shaft and the bearing tube. The bearing arrangement serves as the radially constraining support for the pump gear on one side and for the transmission shaft on the other.

As a practical design choice, the transmission shaft is the input shaft of the transmission. In a further embodiment, the practical choice may be that the transmission shaft is the output shaft of the transmission. Also, in a further embodiment it may be advantageous if the shaft is an intermediate shaft, such as, e.g., the intermediate shaft. The vehicular transmission may be a gear transmission such as a spur gear system or a planetary gear system. The vehicular transmission may also be a continuously variable transmission such as a cone-pulley transmission.

In this, it is particularly practical if the pinion, or in general a gear with external tooth profile, is driven by the transmission shaft.

It is practical, if one of the gears, such as the pinion, is non-rotatably connected to an annular element that has an internal tooth profile mating with an external tooth profile of the transmission shaft.

As a particularly advantageous feature, a seal such as a packing ring is arranged between the transmission shaft and the bearing tube.

It is further practical if the housing of the gear machine or pump is attached to the transmission housing. In this regard, it is advantageous in one embodiment if the housing of the gear machine is arranged on the inside of the transmission housing. In a further embodiment, it is practical if the housing of the gear machine is arranged on the outside of the transmission housing.

Further, it is particularly practical if a seal is interposed between the shaft and the transmission housing.

It is also advantageous if the bearing, e.g., a slide bearing or particularly a roller bearing, is connected to the source of lubricant for the pump or for the transmission through a lubricant-delivery element. In this regard, it is practical if the delivery of lubricant occurs through a connection such as a bore hole or channel that is formed or extends between a chamber filled with lubricant and the bearing. Likewise, it is practical if the lubricant-delivery element is configured as a channel from the bearing to a chamber containing lubricant.

In accordance with the invention it is particularly practical if the transmission shaft, e.g., the input shaft or output shaft of the transmission, passes axially through the bearing tube and interacts on one side with gear-shifting elements inside the transmission and on the other side has a drive connection, e.g., through a toothed profile.

The novel features that are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWINGS

The drawings serve to explain the invention in greater detail through examples, but are not meant to restrict in any way the general scope of the invention.

DETAILED DESCRIPTION OF THE INVENTION

Figure 1:
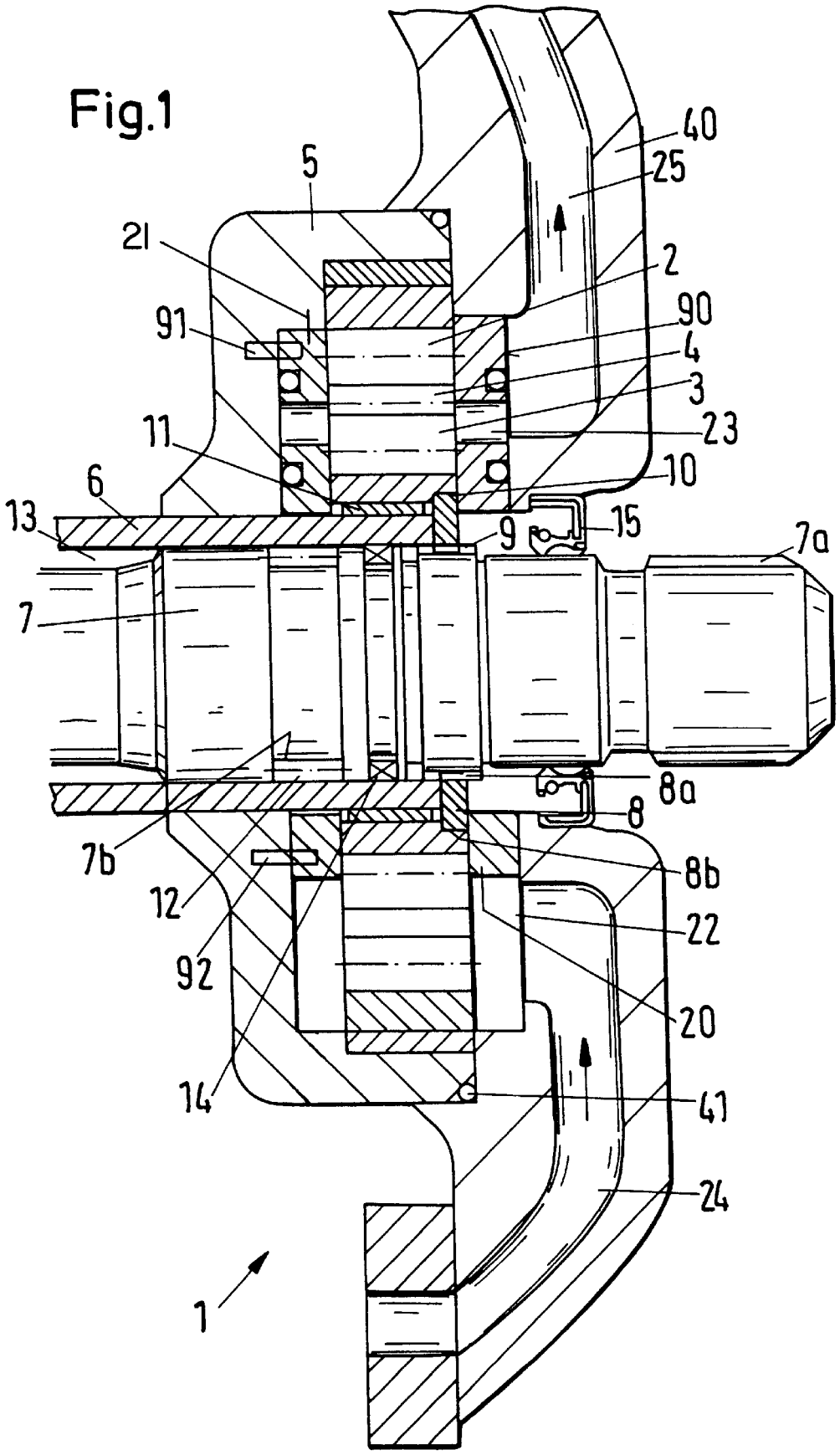
FIG. 1 represents a gear machine, e.g., a pump, in a fragmentary sectional view.
Figure 3:
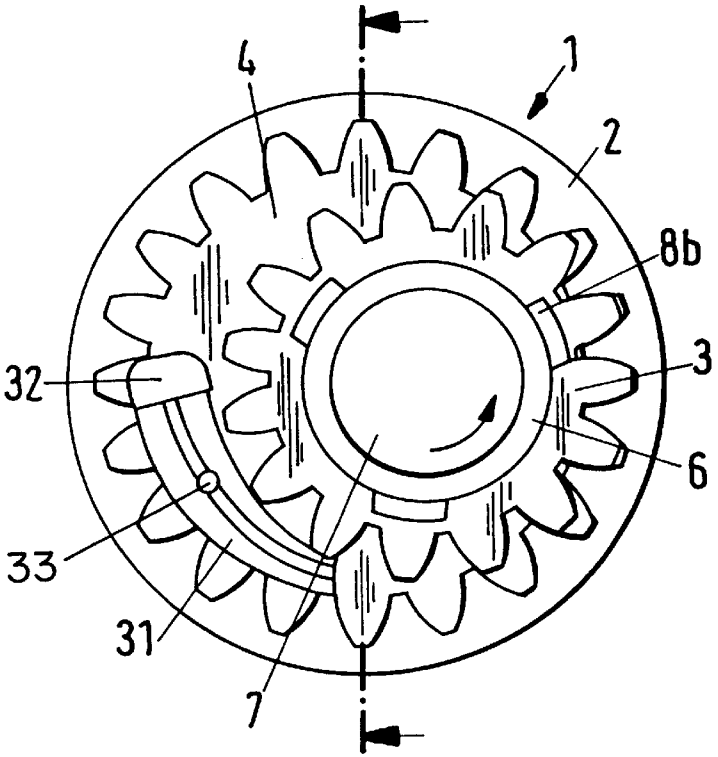
FIG. 3 represents the gear machine of FIG. 1 in an elevational view.

FIGS. 1 and 3 represent a gear machine 1, such as a pump, in which an internally toothed gear 2 and an externally toothed pinion 3 are rotatably arranged and supported in a cavity 4 (such as above) of a housing 5. The pinion 3 is rotatably supported by means of a bearing tube 6 inside the housing 5. A shaft 7, such as a transmission shaft, passes through the bearing tube. The transmission shaft 7 has a connector element 8 such as an essentially annular flange element that is nonrotatably connected to the transmission shaft 7 and is also non-rotatably connected to the pinion 3, so that the pinion 3 will rotate together with the transmission shaft 7.

The flange element 8 has a toothed profile 8*a* at its inner radius or at least individual projections that engage a complementary toothed profile 9 or complementary recesses of the shaft 7. At its outer radius, the flange element 8 has an external toothed profile 8*b* or projections that engage an internal toothed profile 10 or recesses, respectively, of the pinion 3. Preferably, there are at least two projections 8*b* (three in the illustrated example) that engage corresponding recesses of the pinion.

A bearing device 11, such as a roller bearing or slide bearing arrangement, is interposed between the pinion 3 and the bearing tube 6 (the latter being essentially non-rotatable relative to the transmission housing), with the roller elements of the roller bearing arrangement running directly on the outer circumference of the bearing tube 6. Preferably, the bearing tube 6 is hardened to make it suitable for this purpose.

The transmission shaft 7 is rotatably supported inside the bearing tube 6 by means of the bearing 12 and in this case, too, the roller elements of the bearing run directly on the inside surface of the bearing tube. Thus, the bearing tube forms the running surface for the bearing rollers along both its inner and outer radius. The bearing tube 6 serves as supporting element for the transmission shaft 7 itself or for the bearing 12 that holds the transmission shaft. It is advantageous if the bearing 12 is configured as an antifriction bearing such as a roller bearing or needle bearing. In another embodiment, the bearing 12 may also be configured as a slide bearing.

In the design of the bearing 12 it is practical if the bearing is accommodated in a groove 7*b,* such as a circumferential groove, of the shaft 7.

It is particularly advantageous if the bearing 12 is arranged in the axial area of the pump, particularly of the pump gears. In this case, the bearing 12 can take up the radially inward-directed forces of the pump that could cause an at least dynamic deformation of the bearing tube 6. Thus, the dynamic radial forces of the pump are absorbed by the usually massive transmission shaft.

As an advantage of this configuration, the pump does not require an additional drive shaft. The motive power is supplied through the transmission shaft. In several advantageous applications of the invention, the transmission shaft can be supported in a way that no additional bearing device is required on the part of the pump. In these cases, the bearing arrangement comprising the bearing 12 and the bearing tube 6 is the only support of the shaft on the side of the motor or pump.

The delivery of lubricant, such as lubricating oil, to the bearing 12 is accomplished by connecting the bearing compartment to a pressure compartment 13 of the transmission. To achieve this connection, the seal, e.g., in the form of a packing ring 14, that is used for sealing the rotationally nonconstrained passage of the shaft is arranged so that the bearing and the pressure compartment 13 are connected to each other and the seal 14 is not positioned between the pressure compartment 13 and the bearing 12. To perform its function, the packing ring 14 is accommodated in a circumferential groove of the shaft 7 and in firm contact against the inside of the bearing tube. In the axial direction, the seal 14 is arranged between the bearing 12 and the flange 8.

A seal 15, e.g., in the form of a rotary shaft packing ring, seals the transmission shaft against the transmission housing.

It is advantageous to assemble the pump and its housing 5 of a plurality of components, at least of two axial plates 20, 21, and a central housing part 5 with a bore 4. These components delimit and seal off the interior space of the pump where the gears are located, except for the connection 22 and the outflow opening 23. For the connection (inlet) and outflow (outlet), channels 24, 25 are provided in the transmission housing 40.

In an advantageous arrangement, the axial plate 20 is accommodated in a recess 90 of the transmission housing 40 or the transmission housing cover, while the pump housing 5 is set back in relation to the axial plate 20. As a result, with a given axial space allowance this portion of the transmission housing will have a greater wall thickness, which is appropriately used for accommodating the screw threads for attaching the pump 5 (not shown in the drawing).

It is particularly advantageous if the axial plates 20, 21 are fixedly positioned in the pump housing 5 and/or the transmission housing 40 by means of at least two pins 91, 92. These pins are engaged, e.g., in bores or holes of the axial plates and housings. The fixation prevents the axial plates from being moved or rotated out of their correct position by friction forces.

It is also advantageous if at least one of the axial plates 230, 231 is axially fixed in the area of the flange 202 (FIG. 4) and an abutment 32 (see FIG. 3).

Between the two toothed profiles of the internally toothed hollow gear 2 and the externally toothed pinion 3, there is a sickle-shaped cavity forming part of the bore 4 in which at least one filler body 31, or a split filler body with the filler body parts, is arranged that abuts and/or is supported by an abutment pin 32. The abutment pin traverses the cavity 4 and is preferably anchored in the axial plates, conveniently in bore holes. It is advantageous to provide a sealing element 33 between the filler body parts.

The pump housing 5 is attached, e.g., screwed, to the transmission housing 40. At least one sealing gasket 41 is arranged between the pump housing and the transmission housing. As a means of attachment, the pump housing has bore holes (not shown) for bolts to pass through that are screwed into tapped holes in the transmission housing. Thus, the transmission housing does not have to be sealed because of attachment holes.

It is advantageous if the transmission shaft is the input shaft of the transmission because, as a rule, the latter turns at a higher rpm than the output shaft. In such embodiment, it is advantageous for the transmission input shaft to have a toothed profile 7*a* by which it is connected to a drive motor and for the toothed profile to be located outside of the transmission housing 40. Alternatively, if the transmission shaft is the output shaft of the transmission, the toothed profile 7*a* serves to connect the transmission shaft to a further drive train arrangement of the vehicle.

Figure 2:
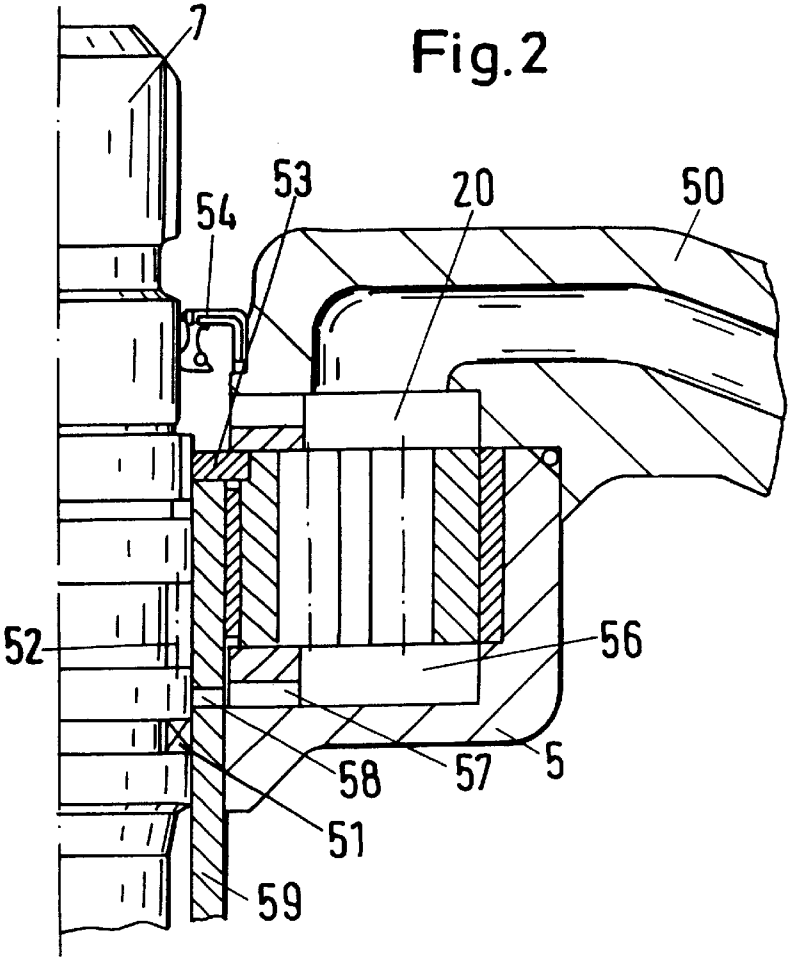
FIG. 2 represents a modified gear machine, e.g., a pump in a fragmentary, sectional view.

FIG. 2 shows a further embodiment wherein a bearing 52 is arranged axially between a seal 51 and a flange or coupling element 53, and the flange 53 is located axially between the seal 54 and the bearing 52. To supply lubricant to the bearing from a low-pressure/high-pressure compartment 56 of the pump, a channel 57 is provided in the housing and a channel 58 in a bearing tube 59 so that the bearing is connected to the compartment 56, which is preferably the low-pressure compartment. The coupling element 53 is conveniently held in place in the axial direction between the axial plate 20 and the pinion 3.

It is particularly advantageous in a pump according to the invention that the bearing tube 6 can absorb transverse forces coming from the pump drive 7.

Figure 4:
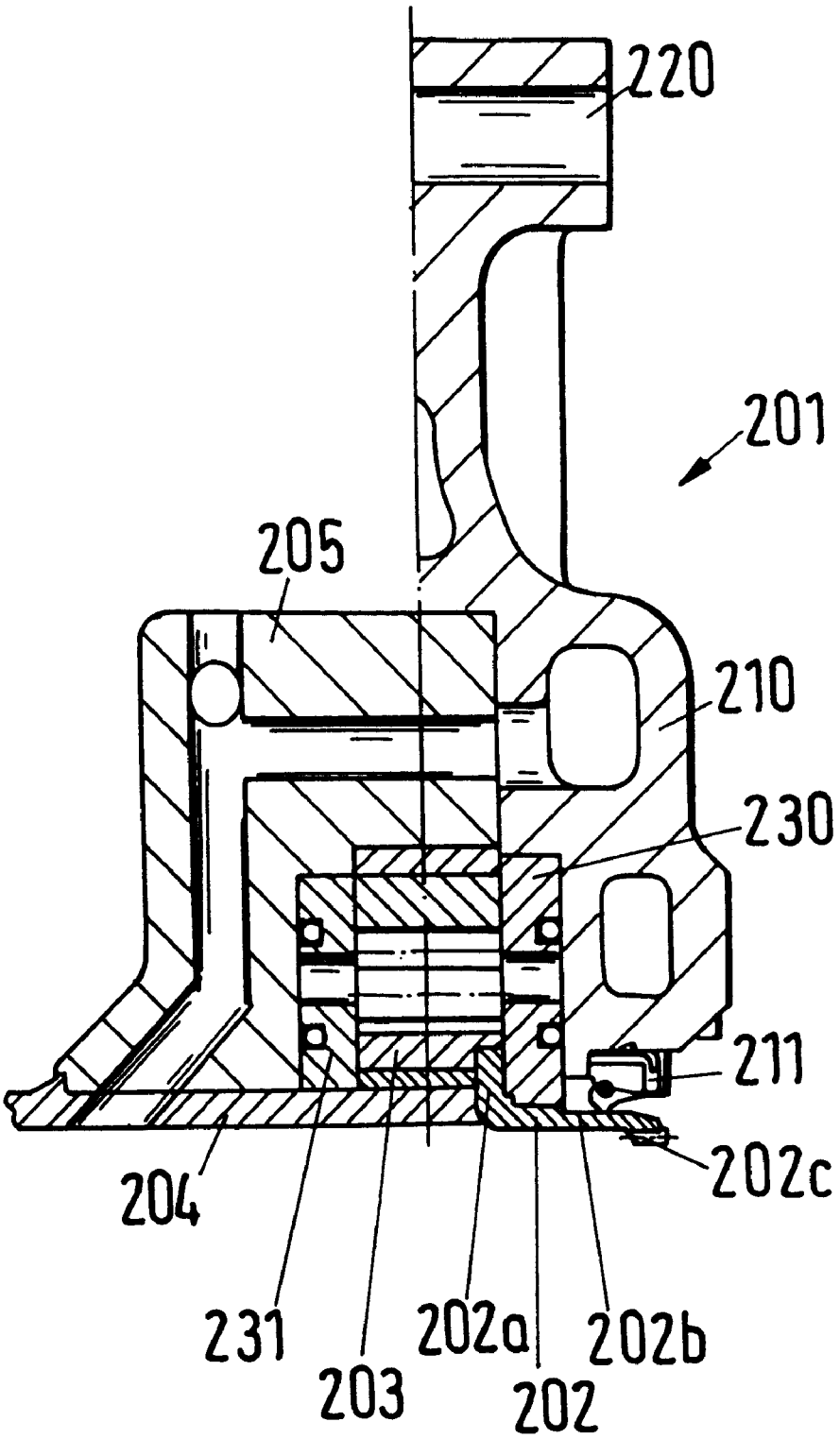
FIG. 4 represents half of a section through a gear machine in accordance with the invention.

FIG. 4 shows a half-section of a pump 201 exemplifying a gear machine where, in contrast to the embodiments of FIGS. 1 to 3, the flange 202 is not disk-shaped but has an L-shaped cross-section. The flange 202 has a radially extending portion 202*a* that is engaged at its outside radius in a toothed profile or in recesses of a pinion 203. Furthermore, the flange has an axially extending portion 202*b,* where a seal 211 is arranged between said portion 202*b* and the housing 210 such as, e.g., a rotary shaft packing ring. At the opposite end from the portion 202*a,* the flange has an inward-facing toothed profile 202*c* engaging a toothed profile of the transmission shaft (not shown) that is accommodated inside the tube 204. Thus, unlike in the arrangement illustrated in FIG. 1, the toothed profile 202*c* is not located inside the space that is closed off by the seal 211.

The transmission housing 210 that supports the pump 201 is configured as a transmission cover that is attached to the actual transmission housing with fastening screws. Fastener holes 220 are provided for this purpose at an outer radius on the cover. Depending on the arrangement of the seals and of the bearing for the transmission shaft (not shown) inside the tube 204, the inside of the transmission can lie either to the left or the right side of the transmission cover 210 in relation to the view shown in FIG. 4, i.e., the pump housing 205 can be arranged at the inside or outside of the transmission housing.

It is advantageous if the bearing tube 204 is a press fit in the pump housing 205 so that the contact surface between the housing and the bearing tube is sealed. In certain cases it is also possible to use a sealing element.

Figure 5:
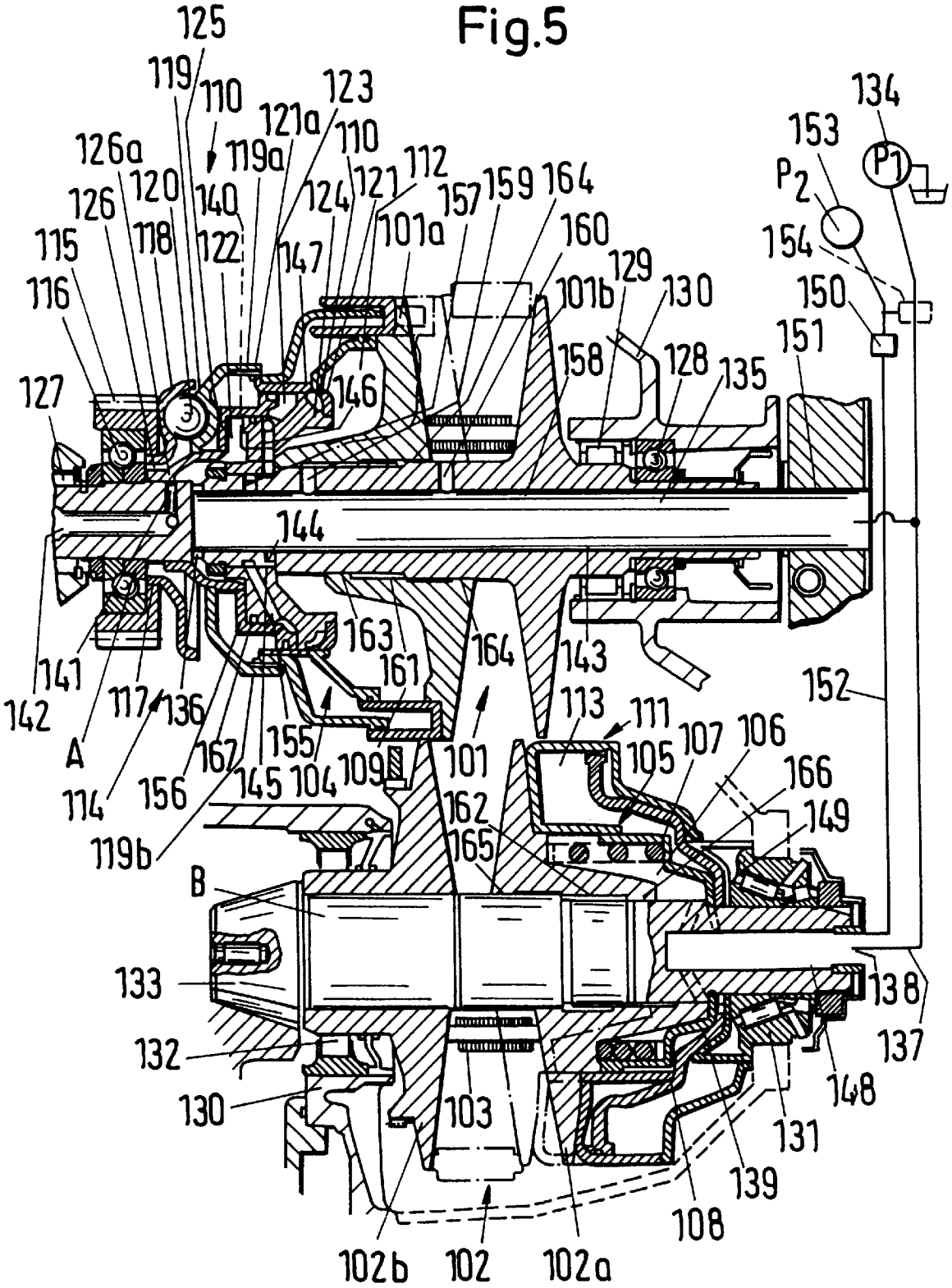
FIG. 5 is a sectional view of a continuously variable transmission.

The design version of a continuously variable conepulley transmission partially represented in FIG. 5 has on the input side a pair of disks (a disk set) 101 non-rotatably mounted on the driving shaft A and a pair of disks 102 non-rotatably mounted on the output shaft B. Each of the disk pairs has an axially movable disk-like part (conical flange) 101*a,* 102*a,* respectively, and an axially fixed disk-like part (conical flange) 101*b,* 102*b,* respectively. An endless loop means in the form of a chain or belt 103 is provided for transmitting torque between the two disk pairs.

In FIG. 5, the upper halves of the representation of the disk pair 101 and of the representation of the disk pair 102 show the respective relative axial positions of the disk-like parts 101*a,* 101*b* and 102*a,* 102*b* corresponding to the slow end of the transmission range (underdrive), while the lower halves of the same representations show the respective relative axial positions of the conical disk pairs 101*a,* 101*b* and 102*a,* 102*b* corresponding to the fast end of the transmission range (overdrive).

The disk pair 101 can be tightened in the axial direction through an actuator 104 configured as a piston/cylinder unit. In similar manner, the disk pair 102 can be axially tightened against the chain 103 through an actuator 105, also configured as a piston/cylinder unit. In the pressure chamber 106 of the piston/cylinder unit 105, an energy storing device 107 is provided in the form of a helical spring urging the axially movable disk 102*a* towards the axially fixed disk 102*b*. When, in the output part of the system, the chain 103 is in a radial position closer to the center of disk pair 102, the tightening force applied by the energy storing device 107 is greater than when the chain 103 is in a radial position farther from the center of disk pair 102. This means that as the transmission ratio is increased towards a faster output, the force applied by the energy storing device 107 also increases. One end convolution of the helical spring 107 bears directly against the axially movable disk 102*a* and at the other end convolution bears against a cup-shaped component 108 that bounds the pressure chamber 106 and is rigidly connected with the output shaft B.

Acting in parallel with the piston/cylinder units 104 and 105, respectively, additional piston/cylinder units 110 and ill are provided for the purpose of varying the transmission ratio. The pressure chambers 112, 113 of the piston/cylinder units 110, 111 can be alternatively filled with or can discharge pressure medium according to the required transmission ratio. For this purpose, the pressure chambers 112, 113 in accordance with requirements can be connected either to a source of a pressure medium such as a pump or else to an outlet channel. Thus, when the transmission ratio is to be changed, one of the pressure chambers 112, 113 is filled with pressure medium, i.e., its volume is increased, while at the same time the other of the pressure chambers 112, 113 is at least partially emptied, i.e., its volume is reduced. This alternating pressurizing of fluid in and emptying of pressure chambers 112 and 113, respectively, can be performed by means of a suitable valve. Concerning the design and the function of this kind of a valve, reference is made in particular to the aforementioned existing state of the art.

To generate an at least torque-dependent pressure, a torque sensor 114 is provided, whose function is based on a hydromechanical principle. The torque, which is introduced through a driving gear or driving pinion 115, is transmitted by the torque sensor 114 to the conical disk pair 101. The driving gear 115 is mounted on the driving shaft A by way of a roller bearing 116 and has a form-locking connection or toothed profile 117, causing it to share its rotation with the cam disk 118 of the torque s-ensor 114 that also bears against the driving gear 115 in the axial direction. The torque sensor 114 has the axially fixed cam disk 118 and an axially movable cam disk 119, both of which have sloped ramps, with spreading bodies in the form of balls 120 arranged between the ramps to spread the cam disks apart. The cam disk 119 is movable in the axial direction along the shaft A but is constrained to rotate together with the latter. For this purpose, the cam disk 119 has a portion 119*a* facing in the opposite axial direction from the balls 120 as well as facing outward in the radial direction and carrying a toothed profile 119*b* engaged in a complementary toothed profile 121*a* of a component 121. The latter has a fixed connection preventing both axial as well as rotational motion of the component 121 in relation to shaft A. At the same time, the toothed profile 119*b* and the complementary profile 121*a* are shaped in relation to each other in a manner that will allow an axial displacement between the components 119 and 121.

The components of the torque sensor 114 define two pressure compartments 122, 123. The pressure compartment 122 is bounded by a ring-shaped component 124 that is rigidly connected to the driving shaft A, as well as by portions or components 125, 126 that are formed on or attached to the cam disk 119. The ring-shaped pressure compartment 123 is arranged at a greater radius than the ring-shaped pressure compartment 122 but is offset from the latter in the axial direction. The second pressure compartment 123, too, is bounded by the ringshaped component 124 and also by the sleeve-like component 121 and further by the ring-shaped component 125, which latter has a fixed connection to cam disk 119, is axially movable, and functions as a piston.

The input shaft A, which carries the torque sensor 114 and the conical disk pair 101, is supported inside a housing 130 by a needle bearing 127 at the end near the torque sensor 114 and at the opposite side of the conical disk pair 101 by a ball bearing 128 taking up the axial forces and a roller bearing 129 taking up radially directed forces. At the shaft end adjacent to the actuators 105 and 111, the driven shaft B that carries the driven disk pair 102 is supported in the housing 130 by a dual-taper roller bearing 131 that takes up forces in the radial as well as both axial directions. On the opposite side (relative to the location of actuators 105 and 111) of the disk pair 102, the driven shaft B is supported in the housing 130 by a roller bearing 132. The driven shaft B at the far end relative to actuators 105 and 111 carries a bevel gear 133 that is operatively connected to, e.g., a differential.

The pressure that is modulated by the torque sensor 114 at least as a function of the torque, as required for tightening the continuously variable cone-pulley transmission, is generated by a pump 134 (PI). Through a tube 135 inside shaft A having at least two chambers and leading to at least one radial channel 136, the pump 134 communicates with the pressure compartment 122 of the torque sensor 114. The pump 134 is further connected via a connecting conduit 137 with the pressure chamber 106 of the piston/cylinder unit 105 associated with the second disk pair 102. The connecting conduit 1~7 leads to a tubular-shaped channel 138 with at least two chambers formed by web portions inside the driven shaft B. The hollow pipe 138, in turn, leads to the pressure chamber 106 via at least one radially oriented channel 139.

The pressure compartment 122 of the torque sensor 114 communicates with the pressure chamber 109 of the piston/cylinder unit 104 via the channel 140, which is offset in the circumferential direction relative to the sectional plane of FIG. 5 and is therefore indicated by broken lines. The channel 140 runs through the ring-shaped component 124 that is rigidly connected to shaft A. Thus, there is a permanent connection between the first pressure compartment 122 and the pressure chamber 109. The driving shaft A is further provided with at least one outlet channel 141 that is connected, or can be connected, with the pressure compartment 122 and whose outlet cross-section is variable as a function of at least the transmitted torque. The outlet channel 141 opens to a central axial bore 142 of shaft A which, in turn, may be connected to a conduit that allows the oil drained from the torque sensor to be directed to locations where it may be used for the lubrication of component parts. The inner portion 126*a* of the ramp disk or cam disk 119 that is supported in an axially movable connection on the driving shaft A forms a closure means for the outlet channel 141 that can close off the outlet channel 141 to a greater or lesser extent dependent on at least the torque that prevents at the particular instant. Thus, the closure means 126*a* in combination with the outlet channel 141 forms a valve, or more precisely, a throttle. Depending at least upon the torque existing between the two cam disks 118 and 119, the outlet opening or the outlet channel 141 is opened or closed to a commensurate degree by the disk 119 acting as a control piston, whereby an amount of pressure originating from the pump 134 and corresponding to at least the momentarily existing torque is introduced at least into the pressure compartment 122. Because the pressure compartment 122 is connected to the pressure chamber 109 and also communicates with the pressure chamber 106 via the channels or conduits 135, 136, 137, 138 and 139, a corresponding pressure is generated also in pressure chambers 109 and 106.

Because the piston/cylinder units 104, 105 are arranged in parallel with the piston/cylinder units 110, 111, the forces arising from the pressure delivered by the torque sensor 114 and acting on the axially movable disks 101*a*, 102*a* are added to the forces bearing against the axially movable disks 101*a*, 102*a* due to the pressure in the chambers 112, 113 that serves to set the transmission ratio.

The pressure chamber 112 is supplied with pressure medium through a channel 143 provided inside the shaft A, which through a radial bore hole 144 is connected to an annular groove 145 on shaft A. Starting from the annular groove 145, at least one channel 146 traverses the ring-shaped component 124 and forms a connection to the radial passageway 147 traversing the sleeve-shaped component 121 and opening to the pressure chamber 112. In a similar manner, the pressure chamber 113, too, is supplied with oil, namely via the channel 148 that surrounds the channel 138 and communicates through radially directed connector channels 149 with the pressure chamber 113. The channels 143 and 148 are supplied from a common pressure source through connecting conduits 151, 152 with at least one valve 150 arranged between them. The pressure source 153 that is connected to the valve 150 or valve system 150 can constitute a separate pump, or else it can also be the already existing pump 134, in which case an appropriate volumeor pressure-distributing system 154 is required, which may comprise a plurality of valves. This alternative solution is indicated with a broken line.

In the relative position of the individual components as shown in the upper half of the representation of the disk pair 101, the pressure compartment 123, whose pressure supply effectively parallels the pressure compartment 122, is separated from a pressure supply, the reason being that the channels or bore holes 155, 156, 157, 158, 159, 160 that communicate with the pressure compartment 123 are not connected with a source of pressure medium such as, in particular, the pump 134. In the illustrated position of the axially movable disk 101*a*, the radial bore hole 160 is fully open so that the compartment 123 is fully relieved from pressure. The axial force acting on the cam disk or ramp disk 119 that is generated by the torque to be transmitted is taken up only through the oil pressure cushion building up in the pressure compartment 122. In this, the higher the pressure in pressure compartment 122 is at a given time, the higher the amount of torque to be transmitted. As already mentioned, this pressure is controlled by the inner portion 126*a* of cam disk 119 and the outlet bore hole 141 acting together as a throttle valve.

When the transmission ratio is to be increased, the conical disk 101*a* is moved to the right in the direction towards the conical disk 101*b*. This has the effect on the conical disk pair 102 that the conical disk 102*a* will back up from the axially fixed conical disk 102*b*. As already mentioned, the upper halves of the representations of the conical disk pairs 101, 102 illustrate the relative positions between the conical disks 101*a*, 101*b* and 102*a*, 102*b* corresponding to the slow end of the transmission range, while the lower halves of the same representations illustrate the relative positions between the conical disks 101*a*, 101*b* and 102*a*, 102*b* corresponding to the fast end of the transmission range.

In order to shift from the transmission ratio of the conical disk pairs 101, 102 illustrated in the upper halves of the representations to the transmission ratio illustrated in the respective lower halves, the valve 150 is regulated so as to fill the pressure chamber 112 and to empty or commensurately reduce the volume of pressure chamber 113.

The axially displaceable conical disks 101*a*, 102*a* are non-rotatably coupled to their respective associated shafts A and B through connections 161, 162 by means of splines. The connections 161, 162 formed by spline fittings on the disks 101*a*, 102*a* and by outward-facing splines on the shafts A and B allow the disks to move in the axial direction along the respective shafts A, B while constraining the disks to rotate together with the respective shafts A, B.

The position of the axially displaceable disk 101*a* and of the chain 103 as shown in dash-dotted lines in the upper half of the representation of the driving disk pair 101 corresponds to the fastest possible transmission ratio. The position of the chain 103 and disk set 101 drawn in dash-dotted lines corresponds to the position of the chain 103 as drawn in solid lines in the lower half of the representation of the driven disk pair 102.

The position of the axially displaceable disk 102*a* and of the chain 103 as shown in dash-dotted lines in the lower half of the representation of the driven disk pair 102 corresponds to the slowest possible transmission ratio. This position of the chain 103 corresponds to the position of the chain 103 drawn in solid lines in the upper half of the representation of the first disk set 101.

In the embodiment shown, the conical disks 101*a*, 102*a* at their inside radii are provided with centering guide portions

163, 164 and 165, 166, respectively, by which they are in immediate contact with and centered on the respective shafts A and B. The centering guide portions 163, 164 of the axially displaceable disk 101*a,* contacting the outer surface of shaft A practically without radial play, in combination with the channels 159, 160 are functioning as valves in which the disk 101*a* in relation to the channels 159, 160 effectively serves as the valve gate. When the disk 101*a* is displaced to the right from the position shown in the upper half of the representation of the disk set 101, after a certain amount of travel the channel 160 is gradually closed off by the centering guide portion 164 as the axial displacement of the disk 101*a* increases. In other words, the centering guide portion 164 is now positioned in the radial sense above the opening of channel 160. In this position, the channel 159, too, is closed off at its outer radial end by the conical disk 101*a,* i.e., by the centering guide portion 163. As the disk 101*a* is moved further in the axial direction towards the disk 101*b,* the channel 160 remains closed while on the other hand the disk 101*a,* i.e., its centering guide portion 163, gradually opens the channel 159. Thereby a connection is established between the pressure chamber 109 of the cylinder/piston unit 104 and the channel 158 via the channel 159 whereby, in turn, a connection to the pressure compartment 123 is made via channels 157, 156 and 155. Given that the channel 160 is effectively closed and a connection now exists between the pressure chamber 109 and the two pressure compartments 122 and 123, the pressure (except for small losses that may occur in the connecting path) will effectively be equalized between the two pressure compartments 122, 123 and the pressure chamber 109 and thus also in the chamber 106, the latter being effectively connected with the compartments 122, 123 and the chamber 109 through the channel 135 and the conduits 137, 138. As the two pressure compartments 122 and 123 are connected to a degree that depends on the transmission ratio, the effective axially facing surface of the pressure cushion in the torque sensor 114 is increased because the combined effects of the axially facing surfaces of the two pressure compartments 122, 123 are additive. Due to this increase in the effective axially directed thrust surface, the amount of pressure generated by the torque sensor in relation to a given amount of torque is reduced essentially in proportion to the surface increase which, in turn, means that a corresponding decrease in pressure is also found in the pressure chambers 109 and 106. Accordingly, by means of the inventive torque sensor 114, it becomes possible to effect a transmission-ratio-dependent modulation of the pressure that is superimposed on the torque-dependent modulation of the pressure. The torque sensor 114 as described allows, in effect, a two-stage modulation of the amount or level of pressure.

In the embodiment described, the two channels 159, 160 in relation to each other and in relation to the portions 163, 164 of the disk 101*a* that interact with the channels 159, 160 are arranged or configured in such a manner that the shift from the one pressure compartment 122 to both pressure compartments 122, 123 and vice versa occurs at a transmission ratio of the continuously variable cone-pulley transmission of approximately 1:1. As indicated previously, due to the design configuration it is not possible for a shift of this kind to occur abruptly, meaning that there is a transition range where on the one hand the outlet channel 160 is already closed but on the other hand the connector channel 159 is not yet connected to the pressure chamber 109. In order to ensure the function of the transmission, i.e., of the torque sensor 114, in this transition range, which requires providing a possibility for the cam disk 119 to be moved along the axial direction, there are equalizer means provided to allow the volume of the pressure compartment 123 to be changed so that the torque sensor 114 can perform its pump action, meaning that the cylinder components and the piston components of the torque sensor 114 can move relative to each other in the axial direction. In the embodiment shown, the aforementioned equalizer means are provided in the form of a sealing tongue or lip 167, which is seated in a radial groove of the ring-shaped component 124 and interacts with the inner cylinder surface of the component 125 in order to seal the two pressure compartments 122, 123 in relation to each other. The seal ring 167 is shaped and arranged in such a manner that it blocks passage, i.e., prevents pressure equalization between the compartments 122 and 123, only in one axial direction while permitting pressure equalization, i.e., passage of the seal ring 167, to occur in the opposite direction at least as long as there is a positive pressure differential between the pressure compartment 123 and the pressure compartment 122. Thus, the seal ring 167 acts not unlike a check valve in that the flow from the pressure compartment 122 to the pressure compartment 123 is blocked while passage through the seal formed by the seal ring 167 is possible when there is a certain amount of overpressure in the pressure compartment 123 relative to the pressure compartment 122. Accordingly, when the ramp disk 119 moves to the right, pressure fluid is allowed to flow from the closed-off pressure compartment 123 into the pressure compartment 122. If the cam disk 119 is subsequently moved to the left, an underpressure may develop in the pressure compartment 123, including even the possibility of air bubbles forming in the oil. However, this is not harmful to the function of the torque sensor or to the continuously variable cone-pulley transmission.

Instead of the seal 167 functioning as a check valve, one could also provide an actual check valve between the two pressure compartments 122, 123 that would be installed in the ring-shaped component 124. In such case, it would be possible to use a seal 167 that works in both axial directions. Further, the check valve referred to above could also be-arranged in such a manner that it would act between the two channels 135 and 158. In this case, the check valve has to be installed in such a way that a volumetric flow is possible in the direction from the pressure compartment 123 to the pressure compartment 122, but the flow of fluid is blocked in the opposite direction.

As can be seen from the preceding description of the operation, practically over the entire part of the range where the transmission effects a speed reduction (underdrive), the axial force transmitted between the ramps of the cam disks 118, 119 bears against the effective axial thrust surface formed by the pressure compartment 122 alone. In contrast, practically over the entire part of the range where the transmission effects a speed increase (overdrive), the axial force transmitted between the ramps of the cam disks 118, 119 bears against both of the effective axial thrust surfaces formed by the pressure compartments 122, 123. Thus, in relation to a given input torque, the pressure generated by the torque sensor 114 is higher when the transmission works in a speed-reducing mode than when it works in a speed-increasing mode. As already mentioned, the transmission described here is configured in such a manner that the switch-over point where a connection or separation between the pressure compartments 122, 123 occurs is in the vicinity of a transmission ratio of approximately 1:1. However, it is possible to change the location of the switch-over point or the switch-over range within the overall range of the cone-pulley transmission through an appropriate arrangement and configuration of the channels 159, 160 and of the portions 163, 164 of the conical disk 101*a* that interact with the channels 159, 160.

The establishment or interruption of communication between the two pressure compartments 122, 123 can also be accomplished by providing for this purpose a special valve that may be arranged in combination with a channel connecting the two pressure compartments 122, 123 where, in addition, this valve need not be controllable directly via the disk 101*a* or 102*a* but may be actuated, e.g., from an external energy source. An electromagnetically, hydraulically, or pneumatically actuable valve that can be switched dependent on the ratio or change in the ratio of the transmission may be used for this purpose. As an example, a so-called 3/2 valve effecting a connection or separation between the two pressure compartments 122, 123 could be employed. However, it is also possible to use pressure valves. A suitable valve of this kind could be arranged in combination with a conduit connecting the two channels 135 and 158, with the two channels 159 and 160 being closed off or omitted in this case. The valve in this arrangement is oriented and connected in such a manner that in the case where the pressure compartments 122, 123 are separated, the valve provides pressure relief to the pressure compartment 123. For this purpose, the valve may be connected to a conduit leading back to the oil sump.

When an externally controllable valve is employed, it becomes possible to also actuate the valve dependent on other parameters. Thus, the valve could also be made to operate dependent on abrupt changes in the driving torque. Thereby, slippage of the chain belt can be avoided or in any case reduced, at least under certain operating conditions or in certain stages of the transmission range of the cone-pulley transmission.

In the design configuration shown in FIG. 5, the torque sensor 114 is arranged on the driving side and adjacent to the axially displaceable conical disk 101*a*. However, the torque sensor 114 may be arranged at and adapted to any arbitrary point in the flow path of the torque. Thus, as is known per se, a torque sensor 114 can also be arranged on the driven side, i.e., on the driven shaft B. A torque sensor of that kind may then be placed adjacent to the axially movable conical disk 102*a* in a similar manner as the torque sensor 114. As is further known, it is also possible to use a plurality of torque sensors. Thus, for example, a suitable torque sensor may be arranged both on the driving side and on the driven side.

Also, the torque sensor 114 may be combined with at least two pressure compartments 122, 123, using other essentially known undertakings to modulate the pressure dependent on the torque and/or dependent on the transmission ratio. Thus, for example, the rolling elements 120 could be displaceable, dependent on a change in the transmission ratio, in the radial direction along the ramps or paths that interact with the rolling elements, similar to the arrangement described in the publication DE-OS 42 34 294.

In the embodiment according to FIG. 5, the pressure chamber 106 is connected to the torque sensor 114. However, the pressure delivered by the torque sensor 114 may also be supplied to the exterior pressure chamber 113, in which case the interior pressure chamber 106 serves the purpose of changing the transmission ratio. To accomplish this, one only has to interchange the connections of the two conduits 152 and 137 to the second disk set 102.

In the embodiment of the torque sensor 114 according to FIG. 5, the components of the torque sensor are made largely of sheet metal. Thus, particularly the ramp disks 118 and 119 can be made as sheet metal stampings, e.g., by press-forming. To control the pressure in the individual pressure chambers, valves V, are provided at least in individual cases where appropriate, with a pressure medium being supplied to the valves from a pump P, through hydraulic conduits 90.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the aforedescribed contribution to the art and, therefore, such adaptations should and are intended to be comprehended within the meaning and range of equivalence of the appended claims.

What is claimed is:

1. A hydraulic gear machine for use in a vehicle with a transmission and a transmission shaft, comprising a gear machine housing, a first gear, a second gear, a central bearing tube, and a bearing, wherein the first gear is rotatably journalled in the gear machine housing, the bearing tube rotatably supports the second gear and receives the transmission shaft, and the transmission shaft is rotatably supported in the bearing tube by means of the bearing, the bearing being radially interposed between the transmission shaft and the bearing tube.

2. The hydraulic gear machine of claim 1, wherein the hydraulic gear machine is an internal-gear pump, the first gear is an internal gear, and the second gear is a pinion.

3. The hydraulic gear machine of claim 1, wherein the transmission has an input shaft and an output shaft and said transmission shaft is the input shaft of the transmission.

4. The hydraulic gear machine of claim 1, wherein the transmission has an input shaft and an output shaft and said transmission shaft is the output shaft of the transmission.

5. The hydraulic gear machine of claim 1, further comprising a seal that is interposed between the transmission shaft and the bearing tube.

6. The hydraulic gear machine of claim 1, wherein the transmission shaft extends axially through the bearing tube.

7. The hydraulic gear machine of claim 1, wherein the second gear is driven by the transmission shaft.

8. The hydraulic gear machine of claim 7, further comprising an annular element having a toothed internal profile, the transmission shaft having a toothed external profile mating with said internal profile, wherein the second gear is non-rotatably connected to the annular element.

9. The hydraulic gear machine of claim 1, wherein the transmission has a transmission housing and the gear machine housing is attached to the transmission housing.

10. The hydraulic gear machine of claim 9, wherein the transmission housing has an inside and the gear machine housing is arranged at the inside of the transmission housing.

11. The hydraulic gear machine of claim 9, wherein the transmission housing has an outside and the gear machine housing is arranged at the outside of the transmission housing.

12. The hydraulic gear machine of claim 9, further comprising a seal that is interposed between the transmission shaft and the transmission housing.

13. The hydraulic gear machine of claim 1, further comprising a lubricant-delivery element, the vehicle having a source of lubricant for at least one of the hydraulic gear machine and the transmission, wherein the lubricant-delivery element connects the bearing to the source of lubricant.

14. The hydraulic gear machine of claim 13, wherein the source of lubricant has a chamber and the lubricant-delivery element comprises a channel leading from the bearing to said chamber.

* * * * *